US005330405A

United States Patent [19]

Habing et al.

[11] Patent Number: 5,330,405

[45] Date of Patent: Jul. 19, 1994

[54] EXERCISE MACHINE

[75] Inventors: Theodore G. Habing, Long Beach; Yong S. Chu, Glendale; Douglas J. Habing, Manhattan Beach, all of Calif.

[73] Assignee: Pacific Fitness Corporation, Cypress, Calif.

[21] Appl. No.: 142,620

[22] Filed: Oct. 25, 1993

[51] Int. Cl.[5] ..... A63B 21/06

[52] U.S. Cl. ..... 482/96; 482/97; 482/102; 482/137; 482/138; 482/908

[58] Field of Search ..... 482/93-104, 482/133-138, 142, 906, 908

[56] References Cited

U.S. PATENT DOCUMENTS

| | | | |
|---|---|---|---|
| 3,446,503 | 5/1969 | Lawton | 482/96 |
| 4,300,760 | 11/1981 | Bobroff | 482/96 |
| 4,627,616 | 12/1986 | Kauffman | 482/96 |
| 4,632,390 | 12/1986 | Richey . | |
| 4,634,118 | 1/1987 | Jensen | 482/96 X |
| 4,655,448 | 4/1987 | Harder | 482/96 X |
| 4,809,972 | 3/1989 | Basmussen et al. | 482/99 |
| 4,844,456 | 7/1989 | Habidh et al. | 482/99 X |
| 4,949,958 | 8/1990 | Richey . | |
| 5,194,059 | 3/1993 | Wu | 482/102 X |
| 5,221,245 | 6/1993 | Yeh | 482/99 X |
| 5,230,680 | 7/1993 | Wu | 482/99 X |
| 5,236,406 | 8/1993 | Webber | 482/99 X |

OTHER PUBLICATIONS

Advertisement-"Bodyforce" by Maximus-1 page.
Brochure-Total Gym Pull-Up Attachment-2 pages.
Brochure-HealthRider-4 pages.
Brochure-The Gravity Edge-2 pages.
Stearns Bench-photo and drawing-2 pages.

*Primary Examiner*—Robert Bahr
*Attorney, Agent, or Firm*—Blakely, Sokoloff, Taylor & Zafman

[57] ABSTRACT

A multi-station exercise machine has a movable subframe on which a user sits while performing various exercises. The subframe is pivotally attached to a stationery frame and is supported by a lever arm that is also pivotally attached to the stationery frame. The pivot arms coupling the subframe to the stationery frame bear against a carriage that is movable located on the lever arm. A cable and pulley system couples the lever arm to the various operable members of the apparatus so that a selectable ratio of the weight of the subframe, including the user, is communicated as exercise resistance. The amount of weight that is coupled to the operable members is selected by positioning the carriage along the lever arm. This adjustment also varies the height to which the subframe is lifted by the exercise stroke and hence the effort that must be exerted by the user.

130 Claims, 5 Drawing Sheets

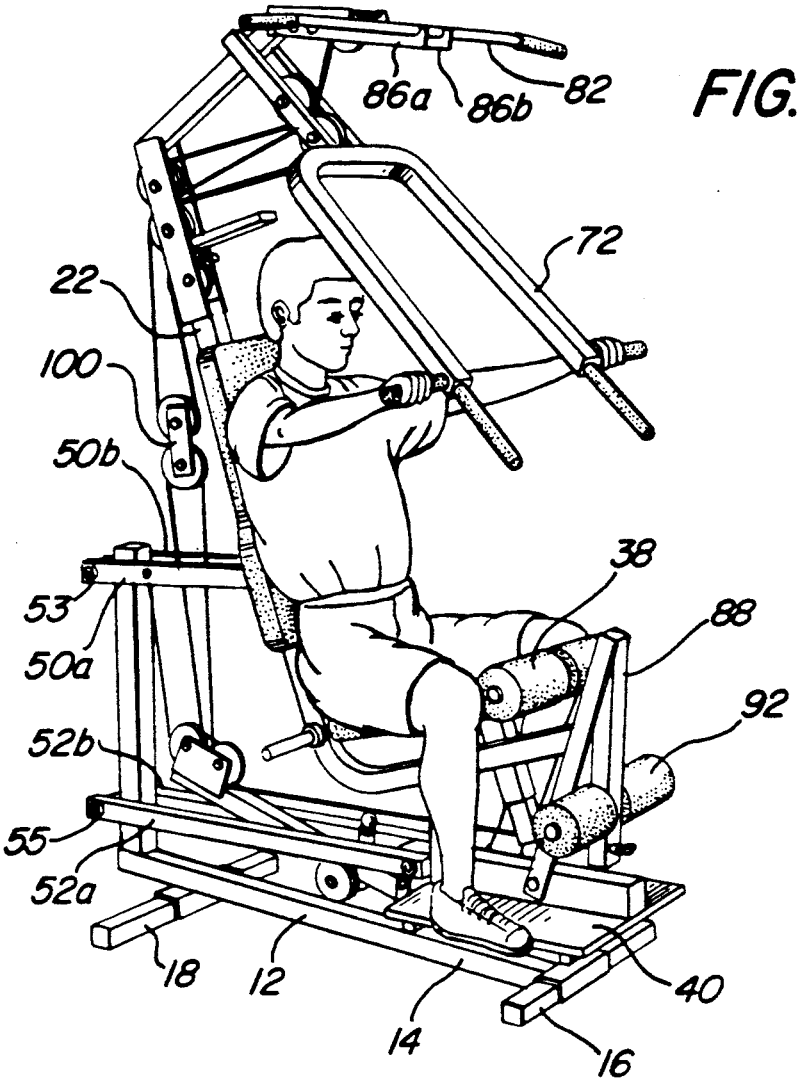
FIG. 1
FIG. 4
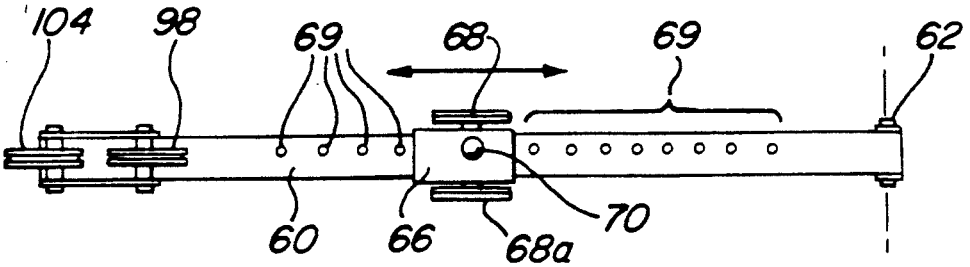

82
72
84
22
100
54
50a
53
94
60
56
46
47
12
55
52a
68a
66

EXERCISE MACHINE

BACKGROUND OF THE INVENTION (1) Field of the Invention

This invention relates to the field of exercise equipment, and particularly to an exercise machine in which at least a substantial portion of the exercise resistance is provided by the body weight of the operator.

(2) Background Art

A wide variety of exercise machines have been developed for exercising various muscle groups of the body. Most such machines employ weights to provide resistance to the operator's exercise movements. Most commonly, a stack of individual weight plates is provided in an arrangement such that a selected number of the weight plates may be coupled to the exercise station by a cable, lever mechanism or other device. Exercise machines of this type typically have a weight stack with a total weight of 200 to 300 pounds. Such weights represent a significant fraction of the cost of an exercise machine, especially when transportation costs are considered. Moreover, conventional weight plates are noisy when the exercise machine is in use.

The use of a person's own body weight as a source of exercise resistance is, of course, well known. For example, many calisthenic exercises, such as push-ups, sit-ups and the like, employ body weight as a source of exercise resistance. Several types of exercise apparatus that use body weight resistance have been commercially introduced. For example, the HealthRider ® is a device for simultaneously exercising muscle groups of the upper and lower body in which the operator is alternately raised and lowered on a seat by operation of the apparatus. The Total Gym ®, marketed by EFI/Total Gym, employs an inclined sled to support the operator. Various exercises available with this machine cause the sled to be pulled up the incline as the operator exercises. The Body Force TM, marketed by Maximus, provides a selectable amount of assistance to an operator while performing body weight exercises such as dips and chin-ups. The Gravity Edge TM has a pivoted platform on which the operator is supported in either a sitting or standing position. The platform is coupled by linkage to an exercise arm such that operation of the exercise arm causes the platform to be lifted.

Other variations of body weight exercise machines are shown in U.S. Pat. Nos. 4,632,390 and 4,949,958, both issued to Richey. These patents disclose devices in which an operator is supported on a generally horizontal bench which is lifted by various exercises. A roller and lever arm arrangement provides adjustment for the amount of body weight that is communicated as exercise resistance.

The various body weight resistance machines mentioned above provide a relatively limited selection of exercises compared to more conventional multi-station exercise machines that employ weight stacks. The latter class of machines has found wide acceptance among exercisers in both the home and health club markets. There is a perceived need for an exercise machine that combines the exercise flexibility of a conventional multi-station exercise machine with the advantages of a machine that derives exercise resistance from the operator's own body weight.

BRIEF SUMMARY OF THE INVENTION

The present invention provides a multi-station exercise machine that has a plurality of exercise members similar in nature to those that are afforded on conventional multi-station exercise machines which utilize a weight stack for providing exercise resistance. Various operable members for performing exercises are coupled to a movable subframe, which also supports a seat for the operator. The subframe is pivotally attached to a stationary frame. In a preferred embodiment of the invention, a lever arm is also pivotally attached to the stationary frame. A carriage movably located on the lever arm acts against a pivot arm that suspends the subframe from the stationary frame. A cable and pulley system couples the lever arm to the various operable members of the apparatus so that a selectable ratio of the weight of the subframe, including the operator, is communicated as exercise resistance. The amount of weight that is coupled to the operable members is selected by positioning the carriage on the lever arm. This adjustment also varies the height to which the subframe is lifted by the exercise stroke and hence the effort that must be exerted by the operator.

In effect, the subframe is a complete multi-station exercise machine, except only for the weights used in conventional exercise machines. The weight of the subframe together with that of the operator is generally more than adequate for providing any desired level of exercise resistance. Thus, the use of a weight stack as has heretofore been conventional with exercise machines of this class is not required. Apart from the advantage of dispensing with conventional weights, the present invention provides a new and exciting exercise sensation as the operator feels the lifting movement while exercising.

In a preferred embodiment of the invention, the subframe comprises a generally L-shaped member having a seat and back rest for the operator. A press arm is pivotally attached to an extension of the subframe at a pivot location generally above the operator's head. A cable is threaded through sets of pulleys on both the subframe member and the press arm and is coupled at one end thereof to a lat bar. The other end of the cable is made available as an intermediate pulling point generally behind the operator's head. The subframe also carries a leg extension arm pivotally suspended forward of the operator's seat and coupled to a second cable. The end of the cable is made available as a low pulling point. The cables are interconnected by a floating pulley assembly such that operation of any of the operable members or cable pulling points is communicated through the entire cable and pulley system to tension both of the cables. The lower cable is threaded through pulleys mounted on the lever arm so that any of the exercise movements will exert a pulling force on the lever arm, thereby lifting the subframe from its rest position to a height that is determined by the selected position of the carriage.

BRIEF DESCRIPTION OF THE DRAWINGS

FIG. 1 is a perspective view of an exercise machine according to the present invention.

FIG. 4 is a detailed top plan view of the lever arm of the exercise machine of FIG. 1.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known exercise methods and devices are omitted so as to not obscure the description of the present invention with unnecessary detail.

Figure 2:
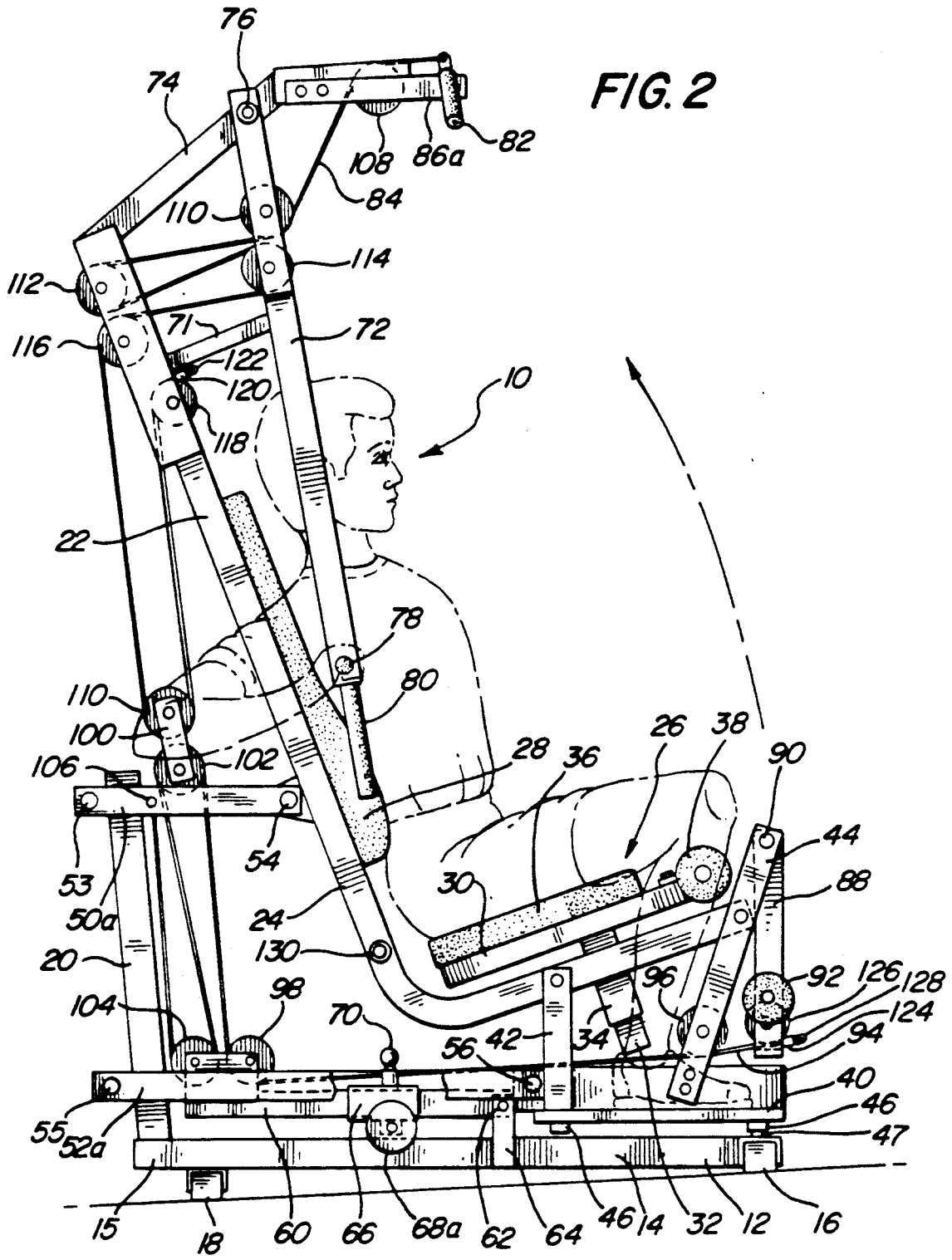
FIG. 2 is a side elevation view of the exercise machine of FIG. 1 showing it in its rest position.
Figure 3:
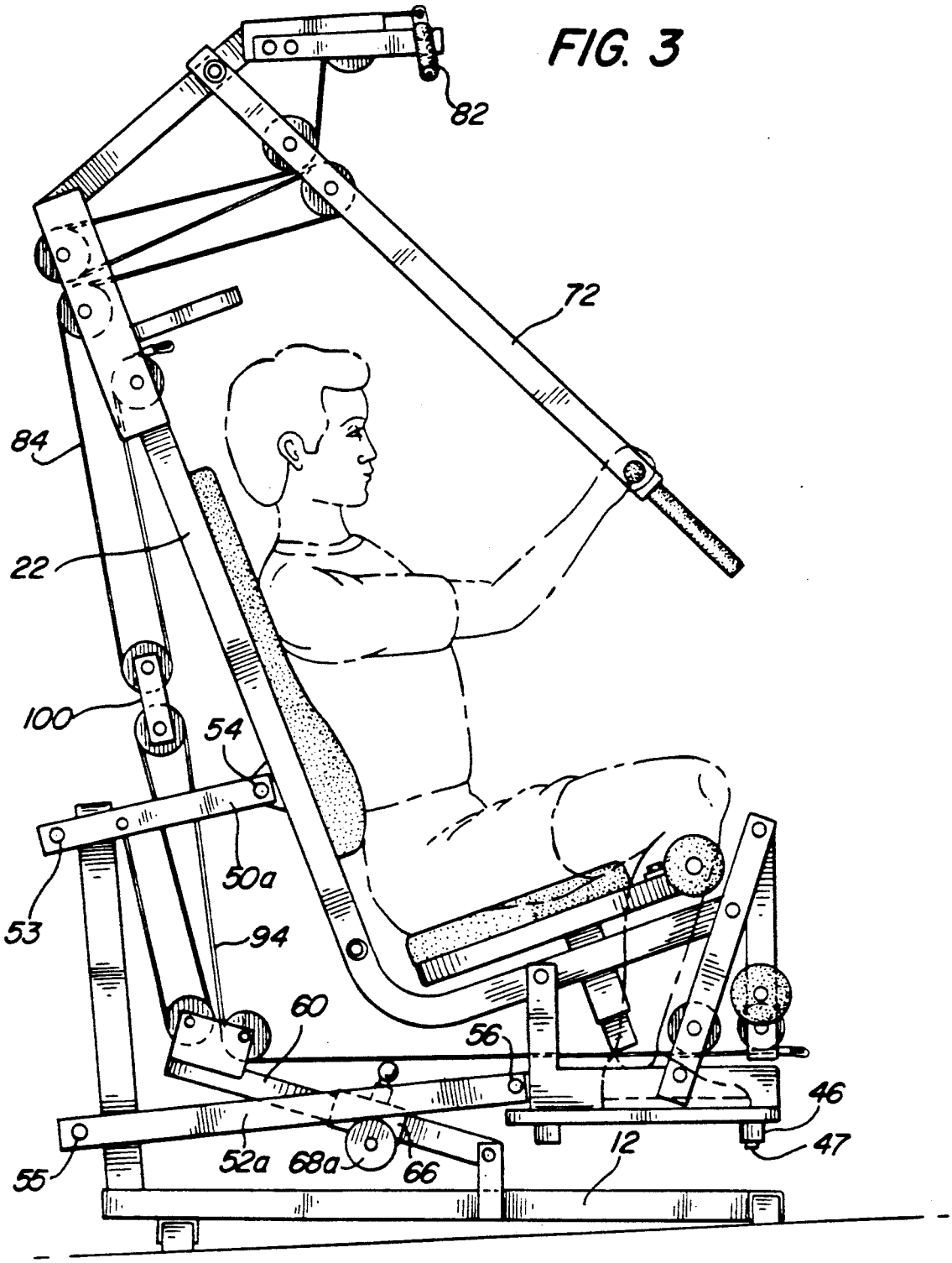
FIG. 3 is a side elevation view of the exercise machine of FIG. 1 showing it in an elevated position.

FIGS. 1-3 illustrate an apparatus 10 constructed in accordance with the present invention. The apparatus is supported by a fixed frame 12 which comprises a main longitudinal member 14. Frame member 14 abuts forward transverse support member 16 and rests on rear transverse support member 18. Upright frame member 20 is secured to rear end 15 of frame member 14.

Fixed frame 12 supports a movable subframe 22 comprising a generally L-shaped member 24. The subframe includes a seat 26 and a back rest 28 to support a user while performing exercises with apparatus 10. It should be observed that, since both seat 26 and back rest 28 are secured to subframe member 24, the relative positions of the support cushions remain fixed while performing exercises, unlike certain prior art devices such as the Gravity Edge TM referred to above.

Seat 26 is secured to subframe member 24 so that it can be adjusted vertically to accommodate users of varying sizes. To provide adjustability, seat frame 30 includes a downwardly extending member 32 which telescopes within tube member 34 secured to subframe member 24. The seat is secured at a desired elevation with a pop pin (not shown) as is common practice for exercise equipment. Seat frame 30 supports seat cushion 36 and knee cushion 38. The latter is provided mainly for support when performing a leg extension or leg curl exercise as more fully described below. When performing other exercises, the user's knees will generally straddle knee cushion 38 as shown in FIG. 1.

Subframe 22 includes a foot support platform 40 suspended from member 24 by members 42 and 44. Cross members 46 provide lateral support for platform 40. Stops 47 on the underside of forward cross member 46 rest against transverse frame member 16 when subframe 22 is in its rest position (illustrated in FIG. 2). Stops 47 are adjustable in height so that the rest position of subframe 22 may be adjusted vertically. The utility of this adjustment will be explained below.

Subframe 22 is coupled to fixed frame 12 by upper pivot arms 50*a*, 50*b* and lower pivot arms 52*a*, 52*b*. Upper pivot arms 50*a*, 50*b* are coupled to upright frame member 20 at pivot 53 and to subframe member 22 at pivot 54. In like fashion, lower pivot arms 52*a*, 52*b* are coupled to upright member 20 at pivot 55 and to subframe member 42 at pivot 56. Subframe 22 is thus coupled to fixed frame 12 by a four-bar linkage so that it remains relatively level as it is lifted from the rest position. The seating position actually reclines somewhat as the subframe is elevated owing to the fact that upper pivot arms 50*a*, 50*b* are shorter than lower pivot arms 52*a*, 52*b*.

Lever arm 60, which is shown in greater detail in FIG. 4, is pivotally coupled to fixed frame 12 at pivot 62, the latter being supported by bracket 64. Carriage 66 is slidably disposed on lever arm 60 and carries rollers 68*a*, 68*b*. These rollers bear against the underside of lower pivot arms 52*a*, 52*b*, respectively. The position of carriage 66 along the length of lever arm 60 is selectable by the user with pop pin 70. This pin, which is spring biased in a downward direction, engages a selected one of a plurality of holes 69 in the upper surface of lever arm 60. As will be better appreciated from the discussion that follows, the position of carriage 66 along the length of lever arm 60 determines the amount of exercise resistance experienced by the user when performing the exercises that are available with apparatus 10 and also varies the height to which subframe 22 is lifted by the exercise stroke. As mentioned above, stops 47 allow the rest position of subframe 22 to be adjusted vertically. This permits pivot arms 52*a*, 52*b* to be aligned parallel with lever arm 60. In turn, this permits carriage 66 to be smoothly positioned anywhere along the lever arm. Although lever arm 60 is a preferred means for transmitting the load of subframe 22 to the cable and pulley system of the apparatus, it should be noted that the load could be transferred directly to one or more of the pivot arms. For example, a cable attachment could be made to a sleeve or carriage that is slidably positionable on the pivot arms.

The principal structural members of apparatus 10 are preferably constructed of square and rectangular section steel tubing as is common practice for exercise equipment. The individual members are joined by welding or by mechanical fasteners as appropriate in each case.

Apparatus 10 incorporates a plurality of operable members coupled to subframe 22 for performing exercises. One such operable member is press arm 72 which is pivotally coupled to subframe member 74 at pivot 76. Press arm 72 is provided with both horizontal grips 78 and vertical grips 80. When not in use, press arm 72 rests against stop member 71 which projects from subframe member 24. A second operable member is lat bar 82 which is suspended on cable 84 at a lat pull down station above the user's head. When not in use, lat bar 82 is retained on brackets 86*a* and 86*b* which extend forwardly from subframe member 74. A third operable member is leg extension arm 88, which is pivotally suspended from subframe member 44 at pivot 90. It is important to note that all of these operable members are mounted on the moving subframe structure and thus remain in a fixed relationship to seat 26 and back rest 28. This is in contrast to most prior art body weight resistance machines that have their operable members mounted on a stationary frame.

Each of the above-mentioned operable members is coupled through the cable and pulley system of apparatus 10 so that as the user exercises, subframe 22 is lifted, thereby providing exercise resistance. To illustrate this, consider first a leg extension exercise using exercise arm 88. As the user applies forward pressure against ankle cushion 92, lower cable 94, which is coupled to arm 88, is placed in tension. Cable 94 passes under pulley 96, which is rotatably mounted on subframe member 44, and then under pulley 98 which is rotatably mounted on lever arm 60. Cable 94 then passes over lower pulley 102 of floating pulley assembly 100 and downwardly under pulley 104 mounted on lever arm 60 adjacent to pulley 98. Cable 94 continues upwardly and is secured between upper pivot arms 50*a*, 50*b* at location 106. As exercise arm 88 is moved forwardly, lever arm 60 is drawn upwardly by the action of cable 94 on pulleys 98 and 104. This, in turn, causes lower pivot arms 52*a*, 52*b* to be lifted by rollers 68*a*, 68*b*, respectively. The lifting force is thus communicated to subframe 22 causing it to be elevated in a nearly linear vertical path as shown by the dashed arrow in FIG. 2.

In a similar fashion, operation of press arm 72 causes subframe 22 to be lifted from its rest position. Upper cable 84, one end of which is coupled to lat bar 82, is routed over pulley 108 on bracket member 86 and then around pulleys 110, 112, 114 and 116 which are alternately mounted on press arm 72 and subframe member 24. Cable 84 then passes around pulley 101 of floating pulley assembly 100 and upwardly over pulley 118 on subframe member 24. Cable 84 terminates with cable stop 120 which is retained against subframe member 24 when cable 84 is in tension. As the user moves press arm 72 forwardly to the position shown in FIG. 3, floating pulley assembly 100 is drawn upwardly causing lever arm 60 to be pulled upwardly by cable 94. Subframe 22 is thus lifted in the same manner described above in connection with operation of the leg extension exercise. It will be observed that use of lat bar 82 pulls downwardly on cable 84 and causes the same result, but without the force multiplying effect experienced with press arm 72 as a result of the serpentine path of cable 84 through pulleys 110–116.

As already mentioned, lower cable 94 is attached between upper pivot arms 50*a*, 50*b* at location 106. This attachment is preferably adjustable to accommodate variations in the lengths of cables 84 and 94 and also to periodically compensate for cable stretch. With this adjustment, which need not have a great range of travel, the cables can be placed in a taut condition while subframe 22 is in its rest position. This removes any slop in the operation of the various operable members. It will be recognized that adjustment of the cable length at attachment 106 will influence the position of lever arm 60, and thus further adjustment of stops 47 may be necessary to maintain a parallel relationship between lever arm 60 and lower pivot arms 52*a*, 52*b*.

As mentioned above, cable 84 terminates with cable stop 120 at pulley 118, which is slightly above and behind the user's head. A loop 122 is secured to this end of cable 84 to permit the attachment of an auxiliary exercise bar or strap (not shown). Additional exercises, such as an abdominal crunch or overhead tricep, can thus be performed from this exercise station. Cable 94 also terminates with a cable stop 124 at pulley 126 on leg extension arm 88. Loop 128 is provided at the end of cable 94 to provide a low pulling point for additional exercises. For example, arm curls and upright row exercises may be performed while standing on platform 40 with an auxiliary exercise bar coupled to an extension chain or cable attached to loop 128. It should be noted that a number of exercises may also be performed using this low pulling point while standing on the floor adjacent to apparatus 10. In this regard, the weight of subframe 22 alone is more than adequate for performing a number of exercises, such as side leg raises.

While the combined weight of subframe 22 and the user seated thereon is generally adequate for providing the maximum desired exercise resistance, additional resistance may be desired by certain users. In this situation, auxiliary weights may be added to subframe 22 on support bars 130. Such auxiliary weights may comprise disc-shaped weight plates of the type that are widely used for barbells and dumbbells.

Figure 5:
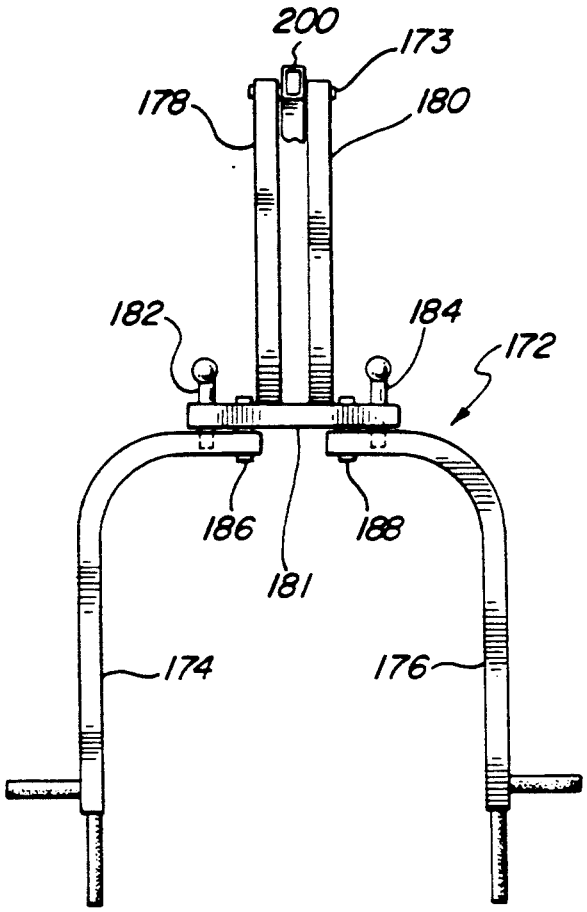
FIG. 5 is a front elevation view of an alternative press arm for use with the exercise machine of FIG. 1.
Figure 6:
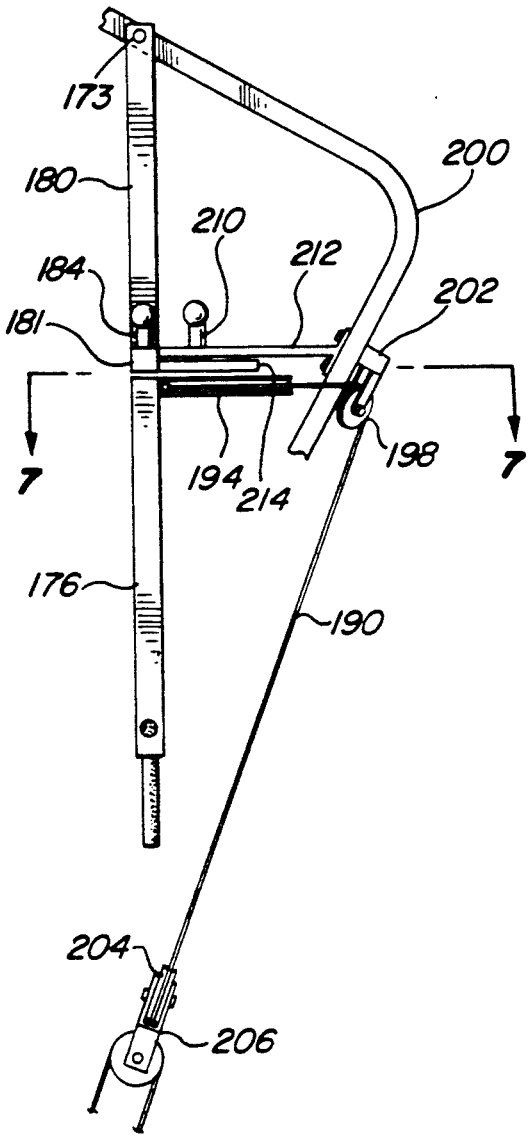
FIG. 6 is a side elevation view of the press arm of FIG. 5.
Figure 7:
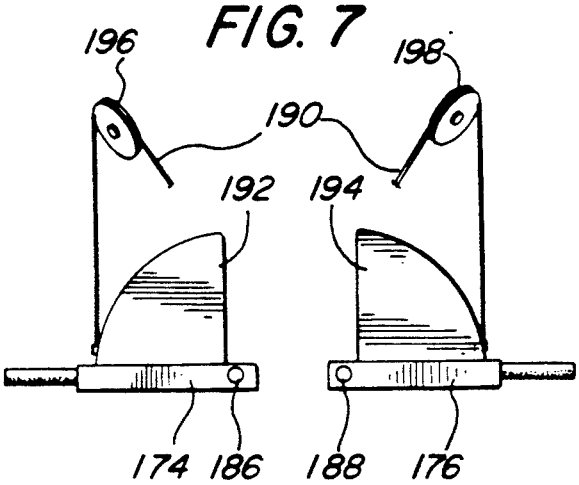
FIG. 7 is a partial cross-sectional view taken through line 7—7 of FIG. 6.

In an alternative embodiment of the present invention, press arm 72 may be replaced with press arm 172 as shown in FIGS. 5–7. Press arm 172 is configured to be used as a conventional press arm, but may also be used to perform a pectoral fly exercise. Upper press arm members 178 and 180 are pivotally coupled to frame member 200 at pivot 173. For use as a conventional press arm, individual arm members 174 and 176 are locked with respect to cross member 181 by pins 182 and 184, respectively. To perform the pectoral fly exercise, pins 182 and 184 are retracted so that arms 174 and 176 are free to rotate about pivots 186 and 188, respectively. In addition, pin 210 is inserted through press arm stop member 212 and into bar 214, which is attached to cross member 181. This locks the upper press arm assembly in position so that it cannot rotate about pivot 173. A plurality of holes for pin 210 are preferably provided in bar 214 so that arms 174, 176 may be optimally positioned with respect to the seat for performing the pectoral fly exercise.

Opposite ends of cable 190 are secured to sectors 192 and 194, which are attached to arms 174 and 176, respectively. Cable 190 is reeved around pulleys 196 and 198 mounted on subframe arm 202 and around floating pulley 204. Pulley 204 is the upper member of floating pulley assembly 206 which communicates with the remainder of the apparatus in the same manner as discussed above.

In yet a different configuration, the press arm may combine the features of both press arms 72 and 172. In this regard, a press arm with pulleys 110 and 114 and the cable rigging as shown in FIGS. 1–3 may be provided with folding pec fly arms similar to arms 174 and 176 of FIGS. 5–7. In this arrangement, lower cable 94 of apparatus 10 may be conveniently extended from attachment point 106 (this fitting being omitted) to a pulley or "Y" fitting at which it would be coupled to cable 190. The exercise resistance for press exercises would thus be communicated through upper cable 84 with the force multiplying effect of pulleys 110–116, whereas exercise resistance for the pec fly exercise would be communicated through lower cable 94 and cable 190. This arrangement obviates the need for pin 210 since operation of the pec fly arms against the relatively lower amount of resistance communicated by cables 94 and 190 would not tend to displace the press arm assembly about the press action pivot (76 in FIGS. 1–3 or 173 in FIGS. 5–7).

Figure 8:
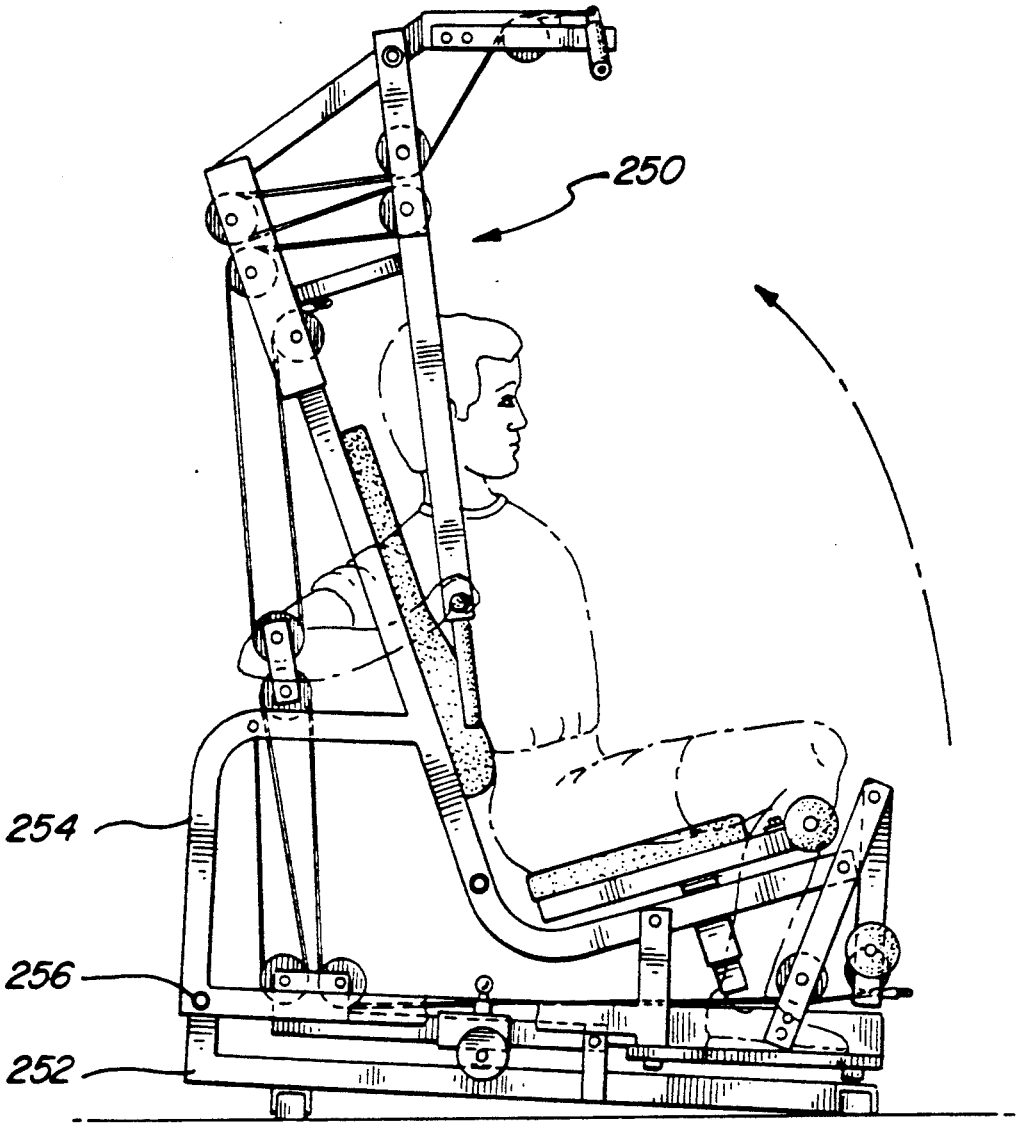
FIG. 8 is a side elevation view of an alternative embodiment of the present invention.

Referring now to FIG. 8, a further alternative embodiment of the present invention is illustrated. In this embodiment, apparatus 250 employs a single pivot arrangement in contrast to the four-bar linkage employed in the previously described embodiment. Subframe 254 of apparatus 250 pivots with respect to fixed frame 252 only at pivot point 256, thus following an arcuate path as indicated by the dashed arrow. The construction of apparatus 250 is somewhat more economical than that of apparatus 10; however, it will be recognized that greater declination of the seating angle is experienced with apparatus 250 as subframe 254 is elevated from its rest position. Except for the pivot arrangement, apparatus 250 is otherwise functionally identical to apparatus 10.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

We claim:

1. An exercise apparatus comprising:

a frame;

a subframe movable with respect to the frame, said subframe having a seat for a user of the apparatus and a press arm pivotally coupled to the subframe for operation by the user while seated in said seat;

linkage means for movably coupling the subframe to the frame;

load bearing means coupled to the frame for supporting the subframe with the user seated thereon;

resistance communication means for coupling the press arm to the load bearing means such that the combined weight of the subframe and the user provides an exercise resistance during operation of the press arm.

2. The exercise apparatus of claim 1 wherein the linkage means comprises a pair of generally parallel horizontal arms, each pivotally coupled to the frame and subframe in a four-bar linkage arrangement.

3. The exercise apparatus of claim 1 wherein the load bearing means comprises a lever arm pivotally coupled to the frame and a bearing member mounted on the lever arm for supporting the subframe.

4. The exercise apparatus of claim 3 wherein the bearing member comprises a bearing wheel.

5. The exercise apparatus of claim 3 wherein the bearing member is adjustably positioned along the lever arm.

6. The exercise apparatus of claim 5 wherein the bearing member comprises a carriage having at least one bearing wheel rotatably mounted thereon and disposed for operative engagement with the linkage means.

7. The exercise apparatus of claim 3 further comprising means for adjusting a rest position of the subframe with respect to a rest position of the lever arm.

8. The exercise apparatus of claim 1 wherein the resistance communication means comprises a cable and pulley system.

9. The exercise apparatus of claim 8 further comprising means for adjusting cable slack of the cable and pulley system.

10. The exercise apparatus of claim 8 wherein the cable and pulley system comprises a first cable coupled to the press arm and a second cable coupled to the load bearing means.

11. The exercise apparatus of claim 10 further comprising a paired set of floating pulleys for interconnecting the first and second cables.

12. The exercise apparatus of claim 10 further comprising a lat bar coupled to the first cable and suspended from the subframe for operation by the user while seated in said seat.

13. The exercise apparatus of claim 10 wherein the first cable is further coupled to at least one exercise station in addition to the press arm.

14. The exercise apparatus of claim 13 wherein said additional exercise station is a pulling point disposed generally behind the user's head when the user is seated in the seat.

15. The exercise apparatus of claim 10 wherein the first cable is coupled to the press arm so as to be free for operation by an exercise member other than the press arm when the press arm is not in use.

16. The exercise apparatus of claim 1 wherein the subframe is pivotally coupled to the frame by the linkage means.

17. The exercise apparatus of claim 1 wherein the load bearing means includes adjustment means for varying the exercise resistance.

18. The exercise apparatus of claim 17 wherein the load bearing means is operatively coupled to the linkage means at an adjustable position therealong.

19. The exercise apparatus of claim 1 wherein the seat comprises a seat cushion and a back rest, both attached to the subframe so as to remain in a fixed relationship with respect to each other as the subframe moves with respect to the frame.

20. The exercise apparatus of claim 1 further comprising at least first and second exercise members in addition to the press arm, each of the press arm and first and second exercise members being operatively coupled to the resistance communication means such that any one of the press arm and first and second exercise members may be operated by the user without uncoupling any other of the press arm and first and second exercise members.

21. The exercise apparatus of claim 1 further comprising a leg extension arm pivotally coupled to the subframe for operation by the user while seated in said seat.

22. The exercise apparatus of claim 21 wherein the resistance communication means comprises a cable and pulley system having a first cable coupled to the press arm and a second cable coupled to the leg extension arm.

23. The exercise apparatus of claim 10 wherein the first cable has first and second ends, each coupled to an exercise station.

24. The exercise apparatus of claim 23 wherein the first end of the first cable is coupled to a lat pull down station and the second end of the first cable is coupled to an abdominal crunch station.

25. The exercise apparatus of claim 1 wherein the press arm comprises a pair of pec fly arms.

26. An exercise apparatus comprising:

a frame;

a subframe movable with respect to the frame, said subframe having a support for the user of the apparatus and an operable member for performing an exercise while the user is supported by said support;

an upper pivot arm pivotally coupled at one end thereof to the frame and at an opposite end thereof to the subframe;

a lower pivot arm pivotally coupled at one end thereof to the frame and at an opposite end thereof to the subframe;

load bearing means for supporting the subframe with the user supported thereon;

resistance communication means for coupling the operable member to the load bearing means such that the combined weight of the subframe and the user provides an exercise resistance during operation of the operable member.

27. The exercise apparatus of claim 26 wherein the load bearing means comprises a lever arm pivotally coupled at one end thereof to the frame.

28. The exercise apparatus of claim 27 wherein the load bearing means further comprises a carriage slidably disposed on the lever arm and having at least one bearing wheel rotatably mounted thereon and disposed for operative engagement with the lower pivot arm.

29. The exercise apparatus of claim 27 further comprising means for adjusting a rest position of the subframe with respect to a rest position of the lever arm.

30. The exercise apparatus of claim 26 wherein the resistance communication means comprises a cable and pulley system.

31. The exercise apparatus of claim 30 wherein the cable and pulley system includes a paired set of floating pulleys.

32. The exercise apparatus of claim 31 wherein the resistance communication means further comprises a first cable reeved about a first one of said paired set of floating pulleys, said first cable being coupled to the operable member, and a second cable reeved about a second one of said paired set of floating pulleys, said second cable being coupled to said load bearing means.

33. The exercise apparatus of claim 32 wherein the first cable is further coupled to at least one exercise station in addition to the operable member.

34. The exercise apparatus of claim 33 wherein said additional exercise station is a pulling point disposed generally behind the user's head when the user is supported by the support.

35. The exercise apparatus of claim 33 wherein said additional exercise station is a lat pull down station disposed generally above the user's head when the user is supported by the support.

36. The exercise apparatus of claim 33 wherein the first cable is coupled to the operable member so as to be free for operation by an exercise member other than the operable member when the operable member is not in use.

37. The exercise apparatus of claim 30 further comprising means for adjusting cable slack of the cable and pulley system.

38. The exercise apparatus of claim 26 wherein the load bearing means includes adjustment means for varying the exercise resistance.

39. The exercise apparatus of claim 38 wherein the load bearing means is operatively coupled to the linkage means at an adjustable position therealong.

40. The exercise apparatus of claim 26 wherein the support comprises a seat cushion and a back rest, both attached to the subframe so as to remain in a fixed relationship with respect to each other as the subframe moves with respect to the frame.

41. The exercise apparatus of claim 26 wherein the operable member is a first exercise member and further comprising at least second and third exercise members in addition to the first exercise member, each of the first, second and third exercise members being operatively coupled to the resistance communication means such that any one of the first, second and third exercise members may be operated by the user without uncoupling any other of the first, second and third exercise members.

42. The exercise apparatus of claim 26 wherein the operable member is one of a plurality of operable members, each disposed on the subframe for performing a respective exercise while the user is supported by said support.

43. The exercise apparatus of claim 26 wherein the operable member is a press arm.

44. The exercise apparatus of claim 26 wherein the operable member is a lat bar.

45. The exercise apparatus of claim 26 wherein the operable member is a leg extension exercise arm.

46. An exercise apparatus comprising:

a frame;

a subframe movable with respect to the frame, said subframe having a support for the user of the apparatus and an operable member for performing an exercise while the user is supported by said support;

linkage means for movably coupling the subframe to the frame;

load bearing means for supporting the subframe with the user supported thereon;

resistance communication means for coupling the operable member to the load bearing means such that the combined weight of the subframe and the user provides an exercise resistance during operation of the operable member, said resistance communication means comprising a first cable coupled to the operable member and a second cable, operably interconnected with the first cable, coupled to the load bearing means.

47. The exercise apparatus of claim 46 wherein the linkage means comprises first and second arms, each pivotally coupled to the frame and subframe in a four-bar linkage arrangement.

48. The exercise apparatus of claim 46 wherein the load bearing means comprises a lever arm pivotally coupled to the frame and a bearing member mounted on the lever arm for supporting the subframe.

49. The exercise apparatus of claim 48 wherein the bearing member comprises a bearing wheel.

50. The exercise apparatus of claim 48 wherein the bearing member is adjustably positioned along the lever arm.

51. The exercise apparatus of claim 50 wherein the bearing member comprises a carriage having at least one bearing wheel rotatably mounted thereon and disposed for operative engagement with the linkage means.

52. The exercise apparatus of claim 48 further comprising means for adjusting a rest position of the subframe with respect to a rest position of the lever arm.

53. The exercise apparatus of claim 46 further comprising means for adjusting cable slack of one of the first and second cables.

54. The exercise apparatus of claim 46 further comprising a paired set of floating pulleys for interconnecting the first and second cables.

55. The exercise apparatus of claim 46 wherein the operable member is a press arm.

56. The exercise apparatus of claim 55 wherein the first cable is coupled to at least one exercise station in addition to the press arm.

57. The exercise apparatus of claim 56 wherein said additional exercise station is a pulling point disposed generally behind the user's head when the user is supported by the support.

58. The exercise apparatus of claim 56 wherein said additional exercise station is a lat pull down station disposed generally above the user's head when the user is supported by the support.

59. The exercise apparatus of claim 55 wherein the first cable is coupled to the press arm so as to be free for operation by an exercise member other than the press arm when the press arm is not in use.

60. The exercise apparatus of claim 46 further comprising a lat bar coupled to the first cable and suspended from the subframe for operation by the user while supported by the support.

61. The exercise apparatus of claim 46 wherein the subframe is pivotally coupled to the frame by the linkage means.

62. The exercise apparatus of claim 46 wherein the load bearing means includes adjustment means for varying the exercise resistance.

63. The exercise apparatus of claim 62 wherein the load bearing means is operatively coupled to the linkage means at an adjustable position therealong.

64. The exercise apparatus of claim 46 wherein the support comprises a seat cushion and a back rest.

65. The exercise apparatus of claim 64 wherein the seat cushion and back rest are both attached to the subframe so as to remain in a fixed relationship with respect to each other as the subframe moves with respect to the frame.

66. The exercise apparatus of claim 46 wherein the operable member is a first exercise member and further comprising at least second and third exercise members in addition to the first exercise member, each of the first, second and third exercise members being operatively coupled to the resistance communication means such that any one of the first, second and third exercise members may be operated by the user without uncoupling any other of the first, second and third exercise members.

67. The exercise apparatus of claim 46 wherein the operable member is one of a plurality of operable members, each disposed on the subframe for performing a respective exercise while the user is supported by said support.

68. An exercise apparatus comprising:

a frame;

a subframe movable with respect to the frame, said subframe having a support for a user of the apparatus and a press arm pivotally coupled to the subframe for operation by the user while supported by said support;

linkage means for movably coupling the subframe to the frame;

load bearing means coupled to the frame for supporting the subframe with the user supported thereon;

resistance communication means for coupling the press arm to the load bearing means such that the combined weight of the subframe and the user provides an exercise resistance during operation of the press arm.

69. The exercise apparatus of claim 68 wherein the linkage means comprises first and second arms, each pivotally coupled to the frame and subframe in a four-bar linkage arrangement.

70. The exercise apparatus of claim 68 wherein the load bearing means comprises a lever arm pivotally coupled to the frame and a bearing mounted on the lever arm for supporting the subframe.

71. The exercise apparatus of claim 70 wherein the bearing member comprises a bearing wheel.

72. The exercise apparatus of claim 70 wherein the bearing member is adjustably positioned along the lever arm.

73. The exercise apparatus of claim 72 wherein the bearing member comprises a carriage having at least one bearing wheel rotatably mounted thereon and disposed for operative engagement with the linkage means.

74. The exercise apparatus of claim 70 further comprising means for adjusting a rest position of the subframe with respect to a rest position of the lever arm.

75. The exercise apparatus of claim 68 wherein the resistance communication means comprises a cable and pulley system.

76. The exercise apparatus of claim 75 further comprising means for adjusting cable slack of the cable and pulley system.

77. The exercise apparatus of claim 75 wherein the cable and pulley system comprises a first cable coupled to the press arm and a second cable coupled to the load bearing means.

78. The exercise apparatus of claim 77 further comprising a paired set of floating pulleys for interconnecting the first and second cables.

79. The exercise apparatus of claim 77 further comprising a lat bar coupled to the first cable and suspended from the subframe for operation by the user while supported by the support.

80. The exercise apparatus of claim 77 wherein the first cable is further coupled to at least one exercise station in addition to the press arm.

81. The exercise apparatus of claim 80 wherein said additional exercise station is a pulling point disposed generally behind the user's head when the user is supported by the support.

82. The exercise apparatus of claim 81 wherein the first cable is further coupled to a lat pull down station disposed generally above the user's head when the user is supported by the support.

83. The exercise apparatus of claim 77 wherein the first cable is coupled to the press arm so as to be free for operation by an exercise member other than the press arm when the press arm is not in use.

84. The exercise apparatus of claim 68 wherein the subframe is pivotally coupled to the frame by the linkage means.

85. The exercise apparatus of claim 68 wherein the load bearing means includes adjustment means for varying the exercise resistance.

86. The exercise apparatus of claim 85 wherein the load bearing means is operatively coupled to the linkage means at an adjustable position therealong.

87. The exercise apparatus of claim 68 wherein the support comprises a seat cushion and a back rest.

88. The exercise apparatus of claim 87 wherein the seat cushion and back rest are both attached to the subframe so as to remain in a fixed relationship with respect to each other as the subframe moves with respect to the frame.

89. The exercise apparatus of claim 68 further comprising at least first and second exercise members in addition to the press arm, each of the press arm and first and second exercise members being operatively coupled to the resistance communication means such that any one of the press arm and first and second exercise members may be operated by the user without uncoupling any other of the press arm and first and second exercise members.

90. The exercise apparatus of claim 68 further comprising a leg extension arm pivotally coupled to the subframe for operation by the user while supported by the support.

91. The exercise apparatus of claim 90 wherein the resistance communication means comprises a cable and pulley system having a first cable coupled to the press arm and a second cable coupled to the leg extension arm.

92. An exercise apparatus comprising:

a frame;

a subframe movable with respect to the frame, said subframe having a support for the user of the apparatus and an operable member for performing an exercise while the user is supported by said support;

an upper pivot arm pivotally coupled at one end thereof to the frame and at an opposite end thereof to the subframe;

a lower pivot arm pivotally coupled at one end thereof to the frame and at an opposite end thereof to the subframe;

resistance communication means for coupling the operable member to one of the upper and lower pivot arms such that the combined weight of the subframe and the user provides an exercise resistance during operation of the operable member.

93. The exercise apparatus of claim 92 wherein the resistance communication means includes a lever arm pivotally coupled at one end thereof to the frame.

94. The exercise apparatus of claim 93 wherein the resistance communication means further includes a carriage slidably disposed on the lever arm and having at least one bearing wheel rotatably mounted thereon and disposed for operative engagement with the lower pivot arm.

95. The exercise apparatus of claim 93 further comprising means for adjusting a rest position of the subframe with respect to a rest position of the lever arm.

96. The exercise apparatus of claim 92 wherein the resistance communication means comprises a cable and pulley system.

97. The exercise apparatus of claim 96 wherein the cable and pulley system includes a paired set of floating pulleys.

98. The exercise apparatus of claim 97 wherein the resistance communication means further comprises a first cable reeved about a first one of said paired set of floating pulleys, said first cable being coupled to the operable member, and a second cable reeved about a second one of said paired set of floating pulleys, said second cable being coupled to said load bearing means.

99. The exercise apparatus of claim 98 wherein the first cable is further coupled to at least one exercise station in addition to the operable member.

100. The exercise apparatus of claim 99 wherein said additional exercise station is a pulling point disposed generally behind the user's head when the user is supported by the support.

101. The exercise apparatus of claim 99 wherein said additional exercise station is a lat pull down station disposed generally above the user's head when the user is supported by the support.

102. The exercise apparatus of claim 98 wherein the first cable is coupled to the operable member so as to be free for operation by an exercise member other than the operable member when the operable member is not in use.

103. The exercise apparatus of claim 96 further comprising means for adjusting cable slack of the cable and pulley system.

104. The exercise apparatus of claim 92 wherein the resistance communication means includes adjustment means for varying the exercise resistance.

105. The exercise apparatus of claim 104 wherein the load bearing means is operatively coupled to one of the upper and lower pivot arms at an adjustable position therealong.

106. The exercise apparatus of claim 92 wherein the support comprises a seat cushion and a back rest.

107. The exercise apparatus of claim 106 wherein the seat cushion and back rest are both attached to the subframe so as to remain in a fixed relationship with respect to each other as the subframe moves with respect to the frame.

108. The exercise apparatus of claim 92 wherein the operable member is a first exercise member and further comprising at least second and third exercise members in addition to the first exercise member, each of the first, second and third exercise members being operatively coupled to the resistance communication means such that any one of the first, second and third exercise members may be operated by the user without uncoupling any other of the first, second and third exercise members.

109. The exercise apparatus of claim 92 wherein the operable member is one of a plurality of operable members, each disposed on the subframe for performing a respective exercise while the user is supported by said support.

110. The exercise apparatus of claim 92 wherein the operable member is a press arm.

111. The exercise apparatus of claim 92 wherein the operable member is a lat bar.

112. The exercise apparatus of claim 92 wherein the operable member is a leg extension exercise arm.

113. An exercise apparatus comprising:

a frame;

a subframe movable with respect to the frame, said subframe having a support for the user of the apparatus and a press arm pivotally coupled to the subframe for operation by the user while supported by said support;

an upper pivot arm pivotally coupled at one end thereof to the frame and at an opposite end thereof to the subframe;

a lower pivot arm pivotally coupled at one end thereof to the frame and at an opposite end thereof to the subframe;

load bearing means for supporting the subframe with the user supported thereon;

resistance communication means for coupling the press arm to the load bearing means such that the combined weight of the subframe and the user provides an exercise resistance during operation of the press arm.

114. The exercise apparatus of claim 113 wherein the load bearing means comprises a lever arm pivotally coupled at one end thereof to the frame.

115. The exercise apparatus of claim 114 wherein the load bearing means further comprises a carriage slidably disposed on the lever arm and having at least one bearing wheel rotatably mounted thereon and disposed for operative engagement with the lower pivot arm.

116. The exercise apparatus of claim 114 further comprising means for adjusting a rest position of the subframe with respect to a rest position of the lever arm.

117. The exercise apparatus of claim 113 wherein the resistance communication means comprises a cable and pulley system.

118. The exercise apparatus of claim 117 wherein the cable and pulley system includes a paired set of floating pulleys.

119. The exercise apparatus of claim 118 wherein the resistance communication means further comprises a first cable reeved about a first one of said paired set of floating pulleys, said first cable being coupled to the press arm, and a second cable reeved about a second one of said paired set of floating pulleys, said second cable being coupled to said load bearing means.

120. The exercise apparatus of claim 119 wherein the first cable is further coupled to at least one exercise station in addition to the press arm.

121. The exercise apparatus of claim 120 wherein said additional exercise station is a pulling point disposed generally behind the user's head when the user is supported by the support.

122. The exercise apparatus of claim 120 wherein said additional exercise station is a lat pull down station disposed generally above the user's head when the user is supported by the support.

123. The exercise apparatus of claim 119 wherein the first cable is coupled to the press arm so as to be free for operation by an exercise member other than the press arm when the press arm is not in use.

124. The exercise apparatus of claim 117 further comprising means for adjusting cable slack of the cable and pulley system.

125. The exercise apparatus of claim 113 wherein the load bearing means includes adjustment means for varying the exercise resistance.

126. The exercise apparatus of claim 125 wherein the load bearing means is operatively coupled to the linkage means at an adjustable position therealong.

127. The exercise apparatus of claim 113 wherein the support comprises a seat cushion and a back rest.

128. The exercise apparatus of claim 127 wherein the seat cushion and back rest are both attached to the subframe so as to remain in a fixed relationship with respect to each other as the subframe moves with respect to the frame.

129. The exercise apparatus of claim 113 wherein the press arm is a first exercise member and further comprising at least second and third exercise members in addition to the first exercise member, each of the first, second and third exercise members being operatively coupled to the resistance communication means such that any one of the first, second and third exercise members may be operated by the user without uncoupling any other of the first, second and third exercise members.

130. The exercise apparatus of claim 113 wherein the press arm is one of a plurality of exercise members, each disposed on the subframe for performing a respective exercise while the user is supported by said support.

* * * * *

US005330405B1

REEXAMINATION CERTIFICATE (3659th)

United States Patent [19]

[11] B1 5,330,405

Habing et al.

[45] Certificate Issued Nov. 3, 1998

[54] EXERCISE MACHINE

[75] Inventors: Theodore G. Habing, Long Beach; Yong S. Chu, Glendale; Douglas J. Habing, Manhattan Beach, all of Calif.

[73] Assignee: Pacific Fitness Corporation, Cypress, Calif.

Reexamination Request:
No. 90/003,686, Jan. 11, 1995

Reexamination Certificate for:

| | |
|---|---|
| Patent No.: | **5,330,405** |
| Issued: | **Jul. 19, 1994** |
| Appl. No.: | **142,620** |
| Filed: | **Oct. 25, 1993** |

[51] Int. Cl.[6] ..... A63B 21/06

[52] U.S. Cl. ..... 482/96; 482/97; 482/102; 482/137; 482/138; 482/908

[58] Field of Search ..... 482/72, 73, 93–104, 482/133–138, 192, 906, 908

[56] References Cited

U.S. PATENT DOCUMENTS

| | | | |
|---|---|---|---|
| 197,750 | 12/1877 | Tuttle | 482/96 |
| 232,217 | 9/1880 | Tuttle | 482/96 |
| 248,121 | 10/1881 | Tuttle . | |
| D. 324,710 | 3/1992 | Habing . | |
| 3,446,503 | 5/1969 | Lawton | 482/96 |
| 4,300,760 | 11/1981 | Bobroff | 482/96 |
| 4,322,071 | 3/1982 | Lambert, Jr. et al. | 482/100 |
| 4,468,025 | 8/1984 | Sferle | 482/96 |
| 4,627,616 | 12/1986 | Kauffman | 482/96 |
| 4,632,390 | 12/1986 | Richey | 482/96 |
| 4,634,118 | 1/1987 | Jensen | 482/96 X |
| 4,641,833 | 2/1987 | Trethewey | 482/96 |
| 4,655,448 | 4/1987 | Harder | 482/96 X |
| 4,809,972 | 3/1989 | Rasmussen et al. | 482/99 |
| 4,844,456 | 7/1989 | Habing et al. | 482/99 X |
| 4,949,958 | 8/1990 | Richey | 482/96 |
| 5,085,430 | 2/1992 | Habing . | |
| 5,120,289 | 6/1992 | Yu | 482/136 |
| 5,194,059 | 3/1993 | Wu | 482/102 X |
| 5,211,614 | 5/1993 | Henes | 482/138 |
| 5,221,245 | 6/1993 | Yeh . | |
| 5,230,680 | 7/1993 | Wu | 482/99 X |
| 5,236,406 | 8/1993 | Webber | 482/99 X |

FOREIGN PATENT DOCUMENTS

| | | | |
|---|---|---|---|
| 445629 | 11/1912 | France . | |
| 2942675 | 10/1979 | Germany | 482/96 |
| 1674870 | 9/1991 | U.S.S.R. . | |
| 1674871 | 9/1991 | U.S.S.R. . | |
| 1674872 | 9/1991 | U.S.S.R. . | |
| 1674873 | 9/1991 | U.S.S.R. . | |
| 1674874 | 9/1991 | U.S.S.R. . | |
| 1674875 | 9/1991 | U.S.S.R. . | |
| 1683789 | 10/1991 | U.S.S.R. | 482/95 |

OTHER PUBLICATIONS

The Gravity Edge Owner's Manual, copyright 1993, SLM Fitness.

Brochure—The Gravity Edge, publication date unstated.

*Primary Examiner*—R. J. Apley

[57] ABSTRACT

A multi-station exercise machine has a movable subframe on which a user sits while performing various exercises. The subframe is pivotally attached to a stationery frame and is supported by a lever arm that is also pivotally attached to the stationery frame. The pivot arms coupling the subframe to the stationery frame bear against a carriage that is movable located on the lever arm. A cable and pulley system couples the lever arm to the various operable members of the apparatus so that a selectable ratio of the weight of the subframe, including the user, is communicated as exercise resistance. The amount of weight that is coupled to the operable members is selected by positioning the carriage along the lever arm. This adjustment also varies the height to which the subframe is lifted by the exercise stroke and hence the effort that must be exerted by the user.

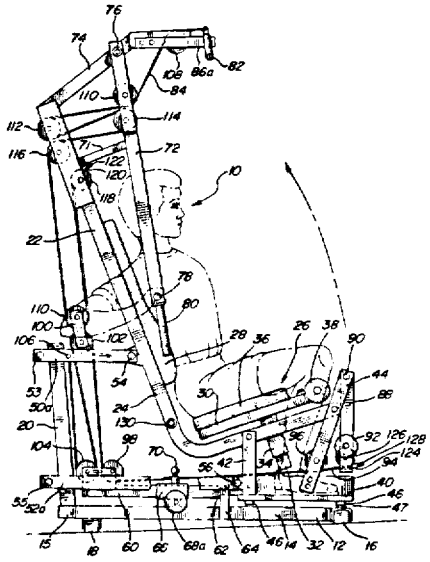

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 20–24, 28, 41, 66, 89–91, 94, 108 and 129 is confirmed.

Claims 1–19, 25–27, 29–40, 42–65, 67–88, 92, 93, 95–107, 109–128 and 130 are cancelled.

* * * * *